United States Patent [19]

Beerens

[11] 4,231,382

[45] Nov. 4, 1980

[54] COOLING STRAND FOR COOLING SMALL-SECTION STEEL

[75] Inventor: Hugo Beerens, Meersbusch, Fed. Rep. of Germany

[73] Assignee: Schloemann-Siemag Aktiengesellschaft, Dusseldorf, Fed. Rep. of Germany

[21] Appl. No.: 914,619

[22] Filed: Jun. 12, 1978

[30] Foreign Application Priority Data

Jun. 16, 1977 [DE] Fed. Rep. of Germany ..... 2727362

[51] Int. Cl.[3] ..... B08B 3/02

[52] U.S. Cl. ..... 134/64 R; 134/199; 266/112

[58] Field of Search ..... 134/64 R, 122 R, 199; 266/112–114

[56] References Cited

U.S. PATENT DOCUMENTS

| | | | |
|---|---|---|---|
| 2,141,382 | 12/1938 | Ferm | 134/64 R X |
| 2,880,739 | 4/1959 | Popp | 134/64 R X |
| 3,436,330 | 4/1969 | Wright et al. | 134/122 R X |
| 3,800,435 | 4/1974 | Woellner | 134/122 R X |
| 3,918,467 | 11/1975 | Alberny et al. | 134/64 R |
| 4,000,625 | 1/1977 | Beerens et al. | 266/114 X |
| 4,064,884 | 12/1977 | Asp | 134/64 R X |
| 4,084,798 | 4/1978 | Dewsnap et al. | 266/114 X |
| 4,124,932 | 11/1978 | Rogove et al. | 266/113 X |

FOREIGN PATENT DOCUMENTS

| | | | |
|---|---|---|---|
| 764672 | 5/1934 | France | 134/122 |
| 739052 | 10/1955 | United Kingdom | 266/112 |
| 388037 | 10/1973 | U.S.S.R. | 266/114 |

*Primary Examiner*—Robert L. Bleutge

*Attorney, Agent, or Firm*—Holman & Stern

[57] ABSTRACT

A cooling strand for cooling small-section steel has individual cooling tubes arranged coaxially in a water trough along the path of travel of the steel sections. Each tube has a constant internal diameter, a diameter to length ratio of from 1:5 to 1:15 and a number of water feed pipes around its circumference at one end. The water feed pipes direct water under pressure into the tubes in a direction opposite to the direction of travel of the steel sections.

4 Claims, 2 Drawing Figures

COOLING STRAND FOR COOLING SMALL-SECTION STEEL

The invention relates to a cooling strand for cooling small-section steel, wherein the sections travel through a plurality of cooling tubes disposed successively in a water container, the outlet end of the cooling tubes being provided with a plurality of circularly disposed pressure water supplies directed opposite to the movement of the sections.

The small steel sections to which this invention applies are for example round, rectangular, half-round, flat, hexagonal, octagonal, angles, T, Z and U sections, i.e. the complete range of merchant mill products.

In modern high output small section rolling mills the final temperature of the rolled material may rise to 1100° to 1200° C. owing to the high driving power and the high outlet speeds. At these temperatures the grain growth speed increases to such an extent that an undesirably coarse grain is produced in some steel qualities. This coarse grain may lead to difficulties during further processing. By arranging a water cooling strand immediately beyond the last strand, the temperature of the rolled material may be reduced so rapidly that grain growth is considerably slowed down.

A cooling strand is already known in which cooling tubes provided with injection nozzles at the periphery are arranged in water containers in order to prevent air from being carried with the rolled material into the interior of the cooling tubes. It is known that the cooling speed can be increased by producing an accumulation pressure in the cooling tubes, and to produce this pressure, pairs of cooling tubes are arranged opposite to each other so that the injection nozzles produce a flow in the same direction as the rolled material in the cooling tube at the inlet end and a flow in opposition to the rolled material in the cooling tube at the outlet end. These oppositely directed flows meet each other in the gap between the cooling tubes, whereby the desired accumulation pressure is produced in the cooling tubes. Cooling tubes arranged in this manner are referred to as pressure cooling tubes.

This known cooling strand has the disadvantage that the cooling is too slow in the first one of the two mutually associated cooling tubes, which has the water flow in the same direction as the rolled material, as a consequence of the small relative movement between the rolled material and the water. Therefore attempts have already been made to increase the turbulence within the cooling tubes so as to accelerate the cooling and to reduce the cooling water consumption. To this end, the bores of the cooling tubes are provided with a plurality of internal restrictions. However, such cooling tubes are very expensive.

According to the invention, there is provided a cooling strand for cooling small-section steel, the strand comprising a water container, and a plurality of cooling tubes arranged coaxially within the water container, each tube having a constant internal diameter and a diameter to length ratio of from 1:5 to 1:15, each tube being provided, at one end thereof, with pipes around the tube circumference for feeding water under pressure into the tube in a direction towards the opposite end of the tube.

The water fed in via the feed pipes distributed around the periphery of the cooling tube produces a suction effect at the section outlet end of the cooling tube, so that an annular water flow in a direction opposite to the bar feed direction is produced in the interior of the cooling tube. This flow continues continuously through all the cooling tubes in the strand, with a portion of the cooling water being interchanged with water from the container in the gap between the individual cooling tubes. In this way a high relative movement between cooling water and sections is produced over the entire cooling strand, so that a high cooling speed is obtained with a low water pressure and low water consumption. A particular advantage of the invention is that in each cooling tube the water speed increases towards the end where the section will enter in consequence of the repeated acceleration of the water flow, so that the most intensive cooling will take place at that end. The cooling tubes are simple to construct and reliable in operation.

The pressure in the water supply pipes is preferably a maximum of 5 bars. In this way normal roll cooling water may be employed.

The internal diameter of the pressure water feed pipes preferably amounts to at least 7 mm. With this diameter, blockages are avoided even when little attention is paid to the cooling water.

In order to avoid corrosion, the pressure water feed pipes may be made of a corrosion resistant material or may be coated on the inside in a corrosion resistant manner.

The invention will now be described, by way of example, with reference to the accompanying drawing, in which.

Figure 1:
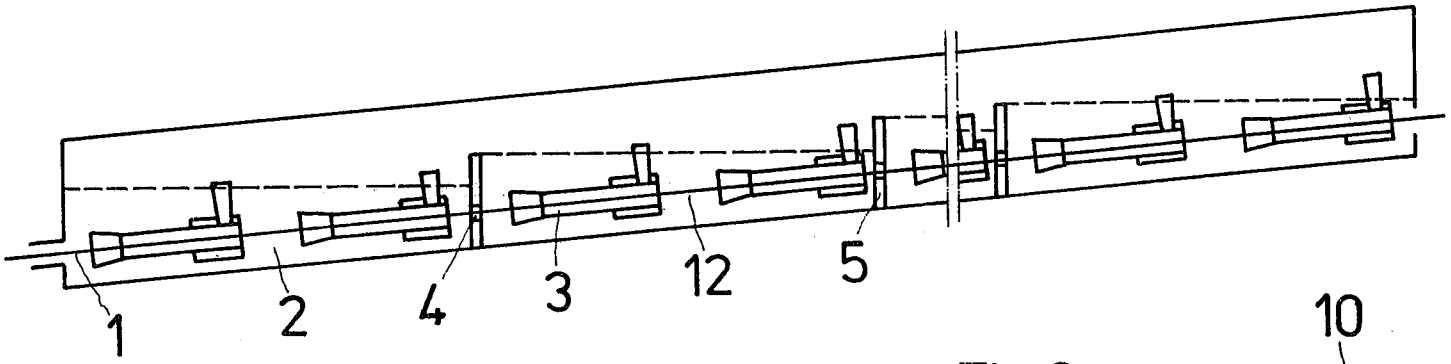
FIG. 1 shows diagrammatically a cooling strand for small-section steel.

The cooling strand for sections 1 illustrated in FIG. 1 consists of a water container 2 in which cooling tubes 3 are arranged successively under water. Since the water container 2 is upwardly inclined, intermediate walls 5 provided with through openings 4 for the sections, are provided for retaining the water.

Figure 2:
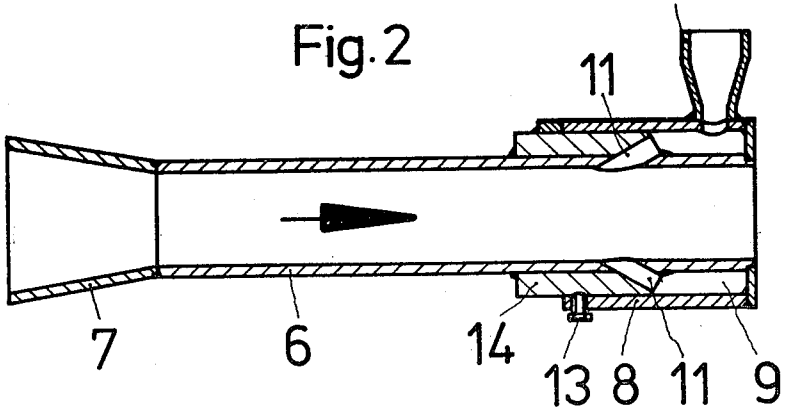
FIG. 2 shows a cooling tube in section.

As may be seen from FIG. 2, each cooling tube 3 consists of an inner guide member 6 with the same internal diameter throughout. An inlet funnel 7 is attached to the inlet end of the guide member 6. At the outlet end of the guide member 6, an outer sleeve 8 is fixed by means of a screw 13 on a ring 14 and an annular water chamber 9 is formed to which a pressure water feed pipe 10 is connected. A plurality of pressure water pipes 11 arranged in a circular manner lead from the water chamber 9 through the ring 14 at an obtuse angle against the section feed direction indicated by an arrow into the interior of the guide member 6.

When the water under pressure is introduced, a suction effect is produced at the outlet end of the guide member 6 and water is drawn from the container 2. The annular water flow thus produced is propagated continuously through all guide members 6. In the gaps 12 between the cooling tubes 3, water is always transferred from the outer region of the flow into the container water, while fresh water is drawn in through the outlet opening of the next tube. In this way water in the cooling tubes 3 is prevented from being over heated.

The repeated introduction of water under pressure into the cooling tubes 3 effects an acceleration of the flow of cooling water and thereby an advantageous increase of the cooling speed towards the section inlet end of the cooling strand.

I claim:

1. A cooling strand for cooling small-section steel passing through said strand in a first direction, the strand comprising:

a water container with water therein;

a plurality of cooling tubes immersed in said water and arranged coaxially within the water container, each tube having a constant internal diameter and a diameter to length ratio of from 1:5 to 1:15;

a plurality of pipes being provided at one end of each tube around the circumference thereof for feeding water under pressure into respective tubes in a direction having a component in opposition to said first direction; and means for providing a flow of water under pressure through said pipes and for inducing a flow of water through said tubes in opposition to said first direction while said steel is moving through the tubes.

2. A cooling strand as claimed in claim 1, including means for producing a pressure in the water feed pipes of a maximum 5 bar.

3. A cooling strand as claimed in claim 1 wherein the internal diameter of said pipes amounts to at least 7 mm.

4. A cooling strand as claimed in claim 1, wherein at least the inside surfaces of the water feed pipes are formed of a corrosion resistant material.

* * * * *